US009860619B2

(12) United States Patent
Pietschmann

(10) Patent No.: US 9,860,619 B2
(45) Date of Patent: Jan. 2, 2018

(54) LOUDSPEAKER BOX ARRANGEMENT AND LOUDSPEAKER BOX

(71) Applicant: ADAM HALL GMBH, Neu-Anspach (DE)

(72) Inventor: Alexander Pietschmann, Usingen (DE)

(73) Assignee: Adam Hall GmbH, Neu-Anspach (DE)

( * ) Notice: Subject to any disclaimer, the term of this patent is extended or adjusted under 35 U.S.C. 154(b) by 0 days.

(21) Appl. No.: 14/974,305

(22) Filed: Dec. 18, 2015

(65) Prior Publication Data

US 2016/0192046 A1 Jun. 30, 2016

(30) Foreign Application Priority Data

Dec. 31, 2014 (DE) ..... 10 2014 227 053

(51) Int. Cl.
*H04R 1/02* (2006.01)
*H04R 1/40* (2006.01)

(52) U.S. Cl.
CPC ..... *H04R 1/026* (2013.01); *H04R 1/403* (2013.01); *H04R 2201/029* (2013.01)

(58) Field of Classification Search
CPC ..... H04R 1/02; H04R 1/025; H04R 1/026; H04R 1/403; H04R 2201/02; H04R 2201/021; H04R 2201/023; H04R 2201/025; H04R 2201/028; H04R 2201/029
See application file for complete search history.

(56) References Cited

U.S. PATENT DOCUMENTS

| | | | | |
|---|---|---|---|---|
| 5,996,728 | A | 12/1999 | Stark | |
| 7,261,180 | B1 | 8/2007 | Faranda et al. | |
| 2002/0121847 | A1* | 9/2002 | Christner | H04R 9/00 312/111 |
| 2011/0305362 | A1* | 12/2011 | McGhee | H04R 1/02 381/386 |

(Continued)

FOREIGN PATENT DOCUMENTS

| | | | |
|---|---|---|---|
| DE | 19524123 | C1 | 2/1997 |
| DE | 20320156 | U1 | 4/2004 |

(Continued)

*Primary Examiner* — Thang Tran
(74) *Attorney, Agent, or Firm* — Sheridan Ross PC

(57) ABSTRACT

This invention refers to a loudspeaker box arrangement with at least two loudspeaker boxes, each comprising at least a mid-range loudspeaker device and a high-range loudspeaker unit arranged at a distance therefrom; with a mechanical connecting device for mechanically connecting the loudspeaker boxes; with an electrical connecting device for the electrical supply of the mid-range loudspeaker device and high-range loudspeaker unit, wherein the mechanical connecting device comprises a pair of spaced-apart guide grooves on a top surface of a loudspeaker box and a compatible pair of guide bases on a mating surface of a neighboring loudspeaker box, which in the mounted state engage each other, and that the electrical connecting device comprises a first pair of electrical contacts in the guide grooves, or the guide grooves are designed as contacts, which are contacted in the mounted state of the mechanical connecting device. Furthermore, the invention refers to a loudspeaker box.

25 Claims, 8 Drawing Sheets

(56) References Cited

U.S. PATENT DOCUMENTS

| | | | | |
|---|---|---|---|---|
| 2014/0270324 | A1* | 9/2014 | Redmond | H04R 1/02<br>381/395 |
| 2015/0289050 | A1* | 10/2015 | Butler | G10K 11/22<br>381/387 |

FOREIGN PATENT DOCUMENTS

| | | | |
|---|---|---|---|
| FR | 2 520 573 | A1 | 7/1983 |
| WO | WO 92/16081 | A1 | 9/1992 |

* cited by examiner

LOUDSPEAKER BOX ARRANGEMENT AND LOUDSPEAKER BOX

This application claims the benefit of German Patent Application No. 102014227053.7, filed Dec. 31, 2014, the entire contents of which are incorporated herein by reference.

FIELD OF THE INVENTION

Embodiments of the present invention relate to a loudspeaker box arrangement with at least two loudspeaker boxes, each comprising at least a mid-range loudspeaker device and a high-range loudspeaker unit arranged at a distance therefrom. The contemplated loudspeaker box arrangement may further comprise a mechanical connecting device for mechanically connecting the loudspeaker boxes and an electrical connecting device for the electrical supply of the mid-range loudspeaker device and the high-range loudspeaker unit. Furthermore, the present invention refers to a loudspeaker box.

BACKGROUND/SUMMARY OF THE INVENTION

In the prior art, loudspeaker boxes are known that can be stacked one on top of the other and fastened to one another. It is further known that the loudspeaker boxes of a tower consisting of loudspeaker boxes are electrically connected to one another.

It is the object of the present invention to make a contribution to the progress of the prior art such that loudspeaker boxes will be easily stackable and connectable in future.

The subject matter of the invention is a loudspeaker box arrangement which comprises a pair of spaced-apart guide grooves on a top surface of a loudspeaker box. In the guide grooves an electrical contact is respectively arranged so that an electrical connection of a loudspeaker box can be implemented via each of the guide grooves. On a loudspeaker box which in the loudspeaker box arrangement is adjacent to the previously described one, a compatible pair of guide bases is arranged on a mating surface. In a mounted state in which the loudspeaker boxes are connected to one another, so that they form at least part of the loudspeaker box arrangement, the guide bases engage into the guide grooves, with an electrical connection between the loudspeaker boxes being established by means of the electrical contacts at the same time. Specifically, the loudspeakers in the loudspeaker box are electrically connected to the electrical contacts. Normally, the top surface and the mating surface are adjacent to each other in the mounted state. Particularly preferably, all of the loudspeaker boxes of the loudspeaker box arrangement are equipped with the same guide bases and the same guide grooves, so that any desired specimens of the loudspeaker boxes can be stacked one on top of the other. Preferably, all of the loudspeaker boxes comprise a pair of guide bases and a pair of guide grooves. These guide bases and guide grooves are preferably electrically connected to one another, so that an electrical signal can be passed through the loudspeaker box. It is thus enough to contact a stack consisting of such loudspeaker boxes at an end for supplying all loudspeaker boxes with an electrical signal. The number of two guide bases and two guide grooves has the advantage that one of the customary two potentials of a signal can respectively be assigned to a guide base and a guide groove and transmitted by these between loudspeaker boxes.

The sub-claims refer to developments of the invention.

In an embodiment of the loudspeaker box arrangement, counter-contacts are respectively arranged on the guide bases. The loudspeakers of the loudspeaker box are electrically connected to the counter-contacts, so that they can receive or transmit an electrical signal therefrom or thereto. In the mounted state, the counter-contacts are electrically connected to the contacts in the guide grooves. Alternatively or in addition, it is conceivable to design the guide bases as counter-contacts. For this purpose they comprise an electrically conductive, particularly metallic surface at least in sections. Said surface is electrically connected to the loudspeakers of the loudspeaker box.

In a further embodiment, the guide bases are slidable into the guide grooves. A mechanically stable connection is established between neighboring loudspeaker boxes by way of form closure, one of said loudspeaker boxes carrying the guide grooves and one the guide bases.

For this purpose the guide bases preferably engage at least one undercut of the guide grooves, especially two undercuts arranged in longitudinal direction and laterally in the guide grooves. Advantageously, two loudspeaker boxes can be connected by means of guide grooves and guide bases in a simple manner, whereby a mechanically very durable connection is established at the same time.

In a further embodiment, the mechanical connecting device is made lockable. To this end a mechanically operable locking device may be provided. With the help of said device a relative movement between a guide groove and a guide base can be blocked or released.

In a further embodiment, a pushbutton is provided on the locking device. A pressing of the pushbutton preferably has the effect that a locking bolt is retracted, whereby a locking between a guide groove and a guide base can be unlocked. The release of the pushbutton entails a locking of the guide groove and the guide base, especially when there is a specific relative position of the guide groove and of the guide base relative to each other, namely especially when the locking bolt can lock into a recess either in the guide groove or in the guide base. The locking bolt is then connected to the guide groove or the guide base and thus particularly to the loudspeaker box in which the recess to be locked is not positioned. To move the locking bolt, a sliding surface which is arranged at least in sections obliquely to the direction of movement of the pushbutton may be connected to the pushbutton. Said sliding surface is in mechanical contact with a further sliding surface which is jointly movable with the locking bolt. Preferably, said further sliding surface is arranged at least in sections obliquely to the direction of movement of the locking bolt. There may be provided several locking bolts that can be operated by the same pushbutton. A respective locking bolt may be provided for locking one of the pairs of guide grooves and guide bases.

In a further embodiment, the loudspeaker box has a width of less than 15 cm, preferably of less than 12 cm. It is then possible to grip a loudspeaker box with only one hand, which facilitates the connection to another loudspeaker box because the other loudspeaker box can thus also be held with a user's second hand to facilitate a relative movement of the two loudspeaker boxes.

In a further embodiment, the pushbutton is arranged laterally on the loudspeaker box. The pushbutton can thereby be operated ergonomically while the loudspeaker box is simultaneously held by a user, particularly with one hand.

In a further embodiment, the loudspeaker boxes are electrically connected in parallel. The contacts and the counter-contacts as well as connections between guide bases and guide grooves through the loudspeaker boxes form a respective electrical path for each of the two potentials of a signal for the supply of the loudspeakers. The loudspeakers of the loudspeaker boxes are respectively connected between these two paths. Particularly for this purpose, a respective connection of a loudspeaker is electrically connected to a contact, a counter-contact and/or a line through the loudspeaker box for the connection of a contact to a counter-contact.

In a further embodiment, a pair of guide grooves is arranged on or in a top surface of a loudspeaker box. A counter-surface in or on which a pair of guide bases is disposed is arranged opposite to the top surface in relation to the loudspeaker box. Thanks to this arrangement of the guide grooves and guide bases the loudspeaker boxes can be stacked into a loudspeaker box arrangement.

In a further embodiment, the loudspeakers of the loudspeaker box are arranged at a loudspeaker side of the loudspeaker box, particularly all loudspeakers. Said loudspeaker side is preferably the side of the loudspeaker box which in relation to the curvature has the greatest radius or forms a convex part of the loudspeaker box arrangement. Therefore, this side is particularly the side of the connection side surfaces between the top surface and the mating surface that bridges the greatest distance between the top surface and the mating surface.

In a further embodiment, the top surface and the mating surface of a loudspeaker box are arranged at an angle of curvature relative to each other. This means that a loudspeaker box comprises two opposite sides which are not parallel with each other. Especially a respective edge of the loudspeaker side relative to the top surface and to the mating surface are more spaced apart from one another than the corresponding edges relative to the opposite rear side of the loudspeaker box. Preferably, the top surface and the mating surface are made rectangular.

In a further embodiment, the loudspeaker box arrangement has an arc which is formed at least by a part of the loudspeaker boxes. Preferably, the whole loudspeaker box arrangement is made at least approximately arcuate. The arc shape is achieved through the top surfaces and mating surfaces of the loudspeaker boxes that are arranged at an angle of curvature relative to one another. A top surface of a loudspeaker box is respectively adjacent to a mating surface of a neighboring loudspeaker box. The top surface and the mating surface are connected by a respective mechanical connecting device. The loudspeaker boxes are also electrically interconnected by the electrical connecting device.

In a further embodiment, a plurality of high-range loudspeakers is arranged in a high-range loudspeaker device. Particularly, these are arranged in a row, with the high-range loudspeakers being arranged in a typical operative position particularly one on top of the other. The high-range loudspeaker device is preferably elongated and has a pronounced longitudinal direction. Particularly preferably, three high-range loudspeakers are arranged in a row.

In a further embodiment, a mid-range loudspeaker is arranged in the loudspeaker box in a side surface, particularly the loudspeaker side. The high-range loudspeaker device is arranged, starting from the mid-range loudspeaker towards the exterior of the loudspeaker box. Particularly, the high-range loudspeaker device is arranged directly in front of the mid-range loudspeaker. Preferably, the high-range loudspeaker device covers a part of the mid-range loudspeaker, particularly about a third of the front surface thereof. Preferably, the high-range loudspeaker device is arranged to extend over the center of the mid-range loudspeaker.

In a further embodiment, at least one high-range loudspeaker is arranged behind an opening in the high-range loudspeaker device, the edge of the opening extending in the direction of the high-range loudspeaker and in the direction of the interior of the loudspeaker box. A funnel-shaped, for instance at least approximately conical or dome section-shaped, edge of the opening is thereby obtained around the high-range loudspeaker, said edge having the effect that the sound is emitted from the high-range loudspeaker in a directed manner. Preferably, at the place of the opening the high-range loudspeaker device has a thickness that entails a funnel-shaped slant of the edge projecting from the high-range loudspeaker to such an extent that a strongly lateral sound emission is suppressed at least in part, particularly mainly or preferably altogether.

In a further embodiment, the high-range loudspeaker device is connected to a chassis of the mid-range loudspeaker. A stable connection of the high-range loudspeaker device to the loudspeaker box is thereby made possible. The chassis of the mid-range loudspeaker can be removed from the loudspeaker box together with the high-range loudspeaker device or the said components can be mounted jointly.

In a further embodiment, a loudspeaker cover is connectable to the chassis of the mid-range loudspeaker. The loudspeaker cover protects the mid-range loudspeaker and the high-range loudspeaker and can be penetrated by sound. The connection can particularly be established by means of one or several magnets. To this end one or several magnets can be arranged on the chassis of the mid-range loudspeaker and/or on the loudspeaker cover.

In a further embodiment, the emission directions of several high-range loudspeakers of a loudspeaker box differ from one another. Specifically, the emission directions of the individual high-range loudspeakers diverge, starting from the loudspeaker box. The orientation of the high-range loudspeaker follows in particular a curvature of the loudspeaker side of the loudspeaker box. Such a curvature can be regarded as a bend of an imaginary line which extends between the top surface and the mating surface and ends vertically on both.

Such an arrangement of the loudspeakers makes it possible to expose—with the help of the loudspeaker box—different regions to sound in a room or in an area to be exposed to sound. This is particularly advantageous for the high-range loudspeakers because the wavelengths of high-pitched tones are shorter and the emission therefore tends to be more directed.

In a further embodiment the high-range loudspeakers are designed as dome loudspeakers with magnetic drive.

In a further embodiment, in order to prevent the penetration of high-range sound into the interior of the loudspeaker box, a foam layer is arranged next to the high-range loudspeaker device, which layer can hardly be penetrated by high-tone sound. This foam layer is preferably arranged substantially parallel to the loudspeaker side. Preferably, two portions that are opposite to each other in relation to the high-range loudspeaker device and are arranged laterally next to the high-range loudspeaker device are arranged as such foam layers. Particularly preferably, the front surface of the mid-range loudspeaker is completely covered by one or more foam layers, as well as the high-range loudspeaker device. Preferably, the foam layers and the high-range loudspeaker device form substantially the part of the loudspeaker side of the loudspeaker box that is accessible from the outside, which may be arranged behind the loudspeaker cover.

In a further embodiment, the loudspeaker box arrangement comprises a connection device by means of which the loudspeaker boxes of the loudspeaker box arrangement can be held mechanically. For this purpose the connection device may be connectable to a wall or a ceiling, particularly of a room, or it may be erected by means of a holder above a floor. The connection device comprises a component of a mechanical connecting device which is compatible with a component of a mechanical connecting device in a loudspeaker box. For instance, the connection device may be connected with the same connecting device to a loudspeaker box, like the loudspeaker boxes among one another. Particularly preferably, a recess into which a locking bolt of a loudspeaker box can lock in place is provided in the connection device. The connection device can thus be designed without a pushbutton.

In a further embodiment, the connection device comprises an electrical connecting device by means of which the loudspeaker boxes can be contacted electrically. This is particularly the same electrical connecting device which is also used between the loudspeaker boxes.

In a further embodiment, electrical components that serve signal modification or power supply of the loudspeaker boxes may be arranged in the connection device. For instance a signal which is passed via the connection device to the loudspeaker box arrangement can thereby be modified, so that it is suited or particularly suited for the loudspeaker boxes.

Alternatively or in addition, electrical components which effect a signal modification of a signal in the respective loudspeaker box may be arranged in one, several or all loudspeaker boxes.

In a further embodiment, the connection device comprises a holding hollow. A holding rod can be inserted into said holding hollow, whereby a mechanical connection is established with a holding device which, in turn, may be connected to a wall, a ceiling, particularly of a room, or to a floor. The holding rod is connected to the holding device for this purpose. The holding rod is aligned in the direction of gravity preferably at its end at which it is to be inserted into the holding hollow. To be able to insert the holding rod into the connection device, the holding hollow is positioned in a bottom side of the connection device which during operation is oriented at least in a roughly approximated manner towards the floor.

In a further embodiment, the connection device comprises a plurality of holding hollows which extend at different angles of inclination into the interior of the connection device. With a corresponding selection of a holding hollow for insertion of a holding rod, the loudspeaker box arrangement can be erected in a simple way at differently inclined angles.

In a further embodiment, the holding hollows are arranged one after the other in a row. This row extends preferably in the center of the bottom side of the connection device, the row being oriented in the direction of the sound emission of the loudspeaker boxes to be connected to the connection device.

In a further embodiment, the connection device is held on a wall or a ceiling; for this purpose a wall holder is fastened thereto. A holding device which may be designed as a holding rod in the above-described sense or as a holding arm is arranged between the wall holder and the connection device. Such a holding arm can be firmly connected to the connection device, e.g. screwed. To prevent the holding device from impeding the mounting of a loudspeaker box onto the connection device, said device may be provided with a hinge, so that the connection device can be pivoted for connection to a loudspeaker box and/or may be inclined in the above-described sense. Furthermore, with the help of the hinge the orientation of the loudspeaker box arrangement can be adjusted in relation to the wall.

In a further embodiment, the connection device may comprise a top side and a mating side that are arranged at an angle of curvature relative to each other, as has already been suggested above for the loudspeaker boxes. The connection device thereby fits harmoniously into the image of an arc which can form the loudspeaker box arrangement.

In a further aspect of the present invention a loudspeaker box is suggested for use in a loudspeaker box arrangement according to any one of the above-described embodiments.

In a still further aspect of the present invention a sound exposure area is suggested that is exposed to sound by means of a loudspeaker box arrangement according to any one of the above-described embodiments.

In such a sound exposure area, the loudspeaker box arrangement is preferably arranged such that it is positioned at least in part above the typical head height of listeners to be exposed to sound. Particularly, the whole loudspeaker box arrangement is positioned above this typical head height. At least when the loudspeaker box arrangement is given an arcuate shape and/or the loudspeaker boxes have an angle of curvature between their top surface and their mating surface, the individual loudspeaker boxes have different main emission directions. Due to the arrangement above the typical head height, listeners at different distances from the loudspeaker box arrangement are then exposed to sound by different loudspeaker boxes in the quality of the main emission direction. At least an approximately uniform sound exposure quality can thereby be achieved for listeners at different distances. Specifically, a coherent wave shape is formed. Preferably, the angle of curvature is between 5° and 15° and particularly preferably between 10°. An advantageous sound distribution can thereby be achieved with the help of the loudspeaker box arrangement with an erection at a distance above the typical head height of the audience.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
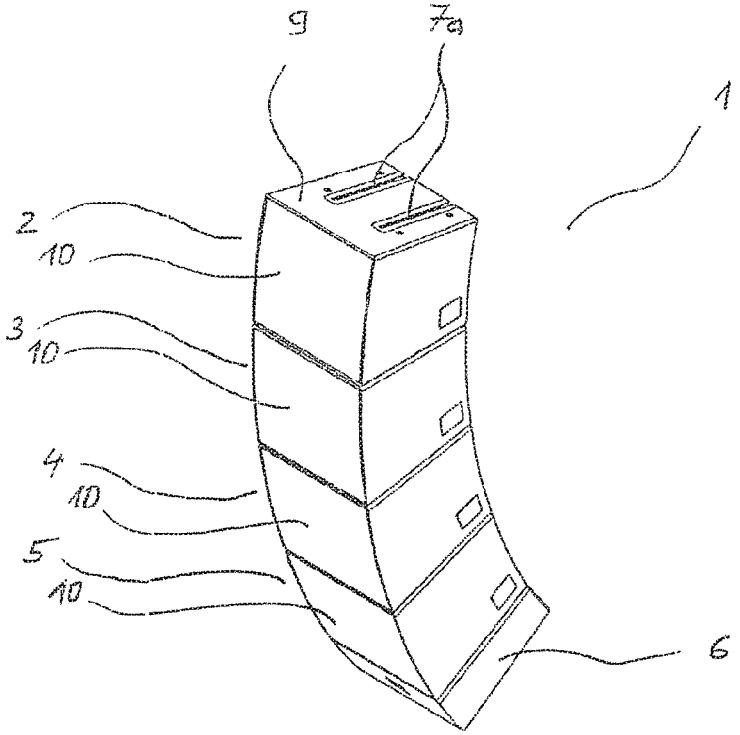
FIG. 1 is a perspective view of a loudspeaker box arrangement obliquely from the front.

To assist in the understanding of one embodiment of the present invention the following list of components and associated numbering found in the drawings is provided herein:

| # | Component |
|---|---|
| 1 | loudspeaker box arrangement |
| 2, 3, 4, 5 | loudspeaker boxes |
| 6 | connection device |
| 7 | mechanical connecting device |
| 7a | guide groove |
| 7b | guide base |
| 9 | top surface |
| 10 | loudspeaker side of a loudspeaker box |
| 12 | holding hollow |
| 13 | rear side of a loudspeaker box |
| 14 | locking device |
| 14a | locking bolt |
| 14b | pushbutton |
| 14c | push rod |
| 14d, 14e | housing elements of the locking device |
| 15 | holder |
| 15 | holding rod |
| 17 | base |
| 18 | electrical connection |

-continued

| # | Component |
|---|---|
| 19 | housing of a loudspeaker box |
| 19a | recess for guide groove |
| 19b | recess for guide base |
| 19c | recess for pushbutton |
| 20 | guide groove carrier |
| 21 | guide base carrier |
| 22 | mid-range loudspeaker |
| 23 | high-range loudspeaker unit |
| 24 | high-range loudspeaker |
| 25 | slant on the high-range loudspeaker unit |
| 26 | chassis of the mid-range loudspeaker |
| 27 | loudspeaker cover |
| 28 | mating surface |
| 29, 30 | side surfaces |
| 31 | bottom side of the connection device |
| 32 | mechanical connecting portion |
| 33 | rear side of the connection device |
| 34 | cable fastening device |
| 35 | housing |
| 35a | recesses for guide grooves |
| 35b | openings for holding hollows |
| 35c | opening for flange accommodation |
| 36 | inner part |
| 37 | bulge in the inner part |
| 38 | front panel |
| 39 | loudspeaker connection |
| 40 | fastening screws for the inner part |
| H | hand of an operator |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

FIG. 1 is a perspective view of the loudspeaker box arrangement 1 obliquely from the front. The loudspeaker box arrangement 1 comprises four loudspeaker boxes 2, 3, 4, 5 and a connection device 6. The loudspeaker box arrangement 1 has the shape of a section of an arc.

The loudspeaker boxes 2, 3, 4, 5 emit sound above all via their respective loudspeaker side 10. The loudspeaker boxes 2, 3, 4, 5 are detachably fastened to one another. The loudspeaker box 5 is detachably fastened to the connection device 6. To fasten the loudspeaker boxes 2, 3, 4, 5 and the connection device 6, a connecting device is respectively provided between two neighboring ones of the said elements of the loudspeaker box arrangement 1, the connecting device being not visible in FIG. 1 between the elements. A component of the connecting device 7, which is configured as a pair of guide grooves 7*a*, is arranged on a top surface 9 of the loudspeaker box 2. A further loudspeaker box (not shown) can be fastened by means of the guide grooves 7*a* to the loudspeaker box arrangement 1. Loudspeaker box arrangement 1 is thereby extensible. By removing loudspeaker boxes 2, 3, 4, 5, particularly loudspeaker boxes on the end facing away from the connection device 6, the loudspeaker box arrangement 1 can be reduced in size. As an alternative to the illustrated embodiment, the loudspeaker box arrangement 1 may comprise a different number of loudspeaker boxes 2, 3, 4, 5.

Figure 2:
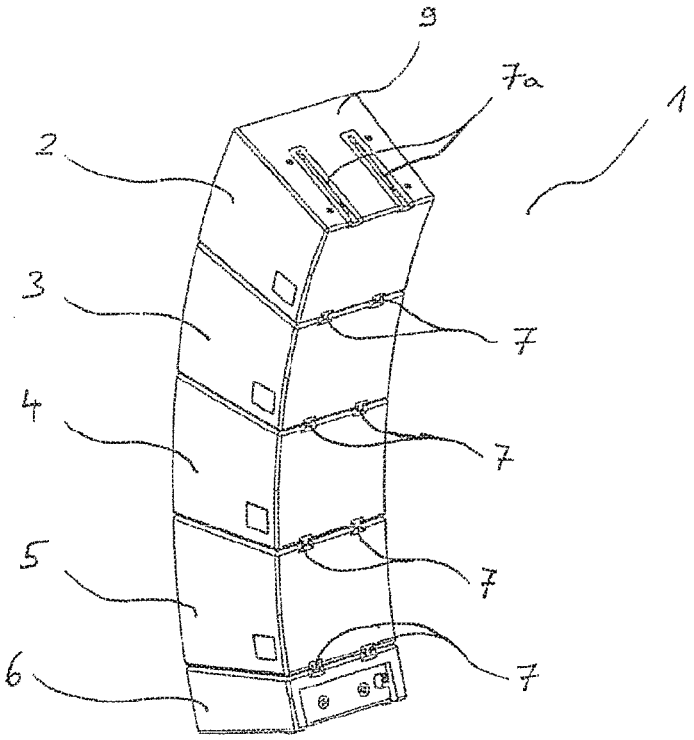
FIG. 2 is a further perspective view of the loudspeaker box arrangement obliquely from behind.

FIG. 2 shows the loudspeaker box arrangement 1 of FIG. 1 in a perspective view obliquely from behind. Like features are marked with like reference numbers and are not described once again separately; reference is here made to FIG. 1. In FIG. 2, the ends of the connecting devices 7 between the loudspeaker box 5 and the connection device 6 can be seen in addition.

Figure 3:
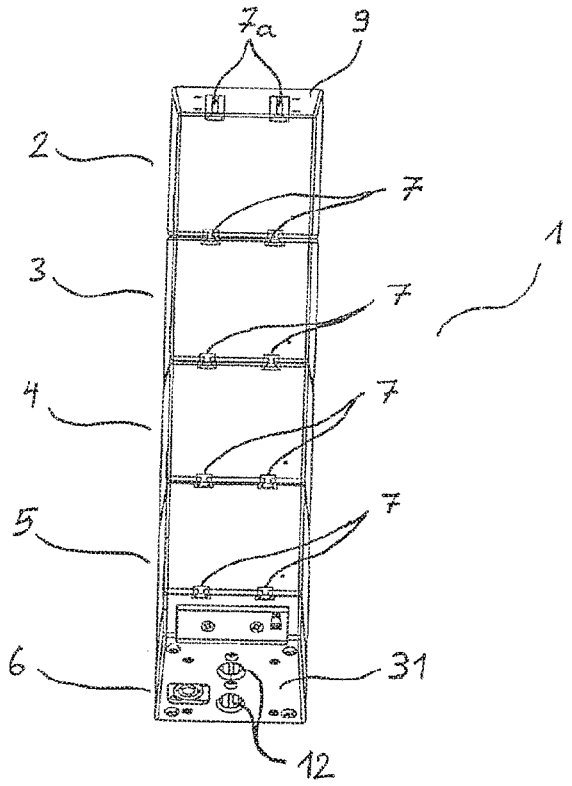
FIG. 3 is a view of the loudspeaker box arrangement from behind.

FIG. 3 shows the loudspeaker box arrangement 1 of FIGS. 1 and 2 in a view from behind. Like features are marked with like reference numbers and are not described once again separately; reference is here made to FIGS. 1 and 2. In contrast to FIGS. 1 and 2, the bottom side 31 of the connection device 6 can be seen in FIG. 3. Two holding hollows 12 are arranged in the bottom side 31. These extend at different angles of inclination into the interior of the connection device 6.

Figure 4:
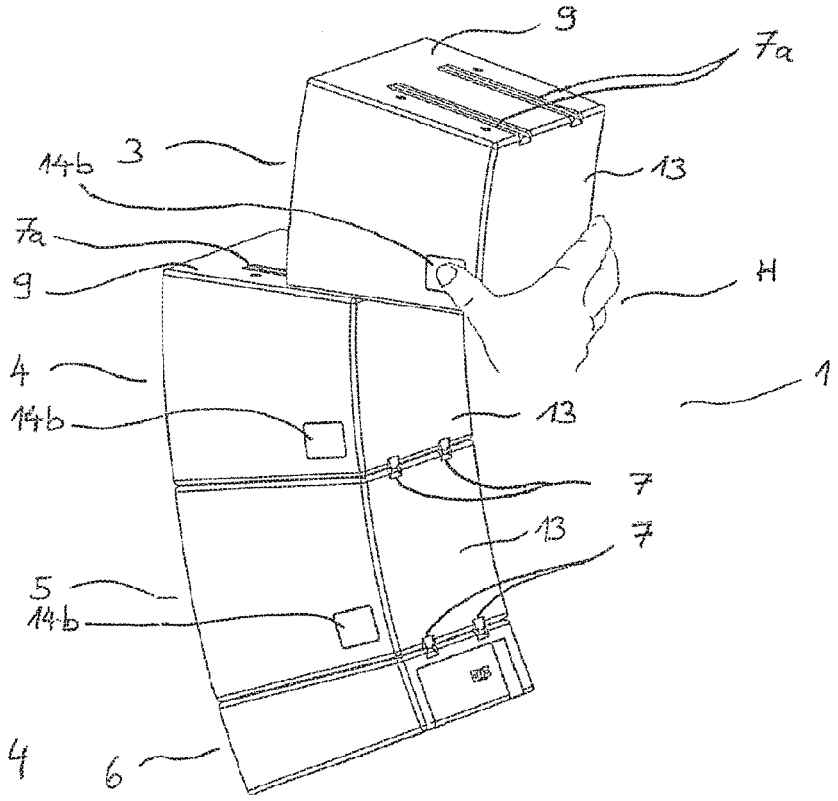
FIG. 4 is a perspective view showing the mounting or dismounting of a loudspeaker box on the loudspeaker box arrangement.
Figure 5:
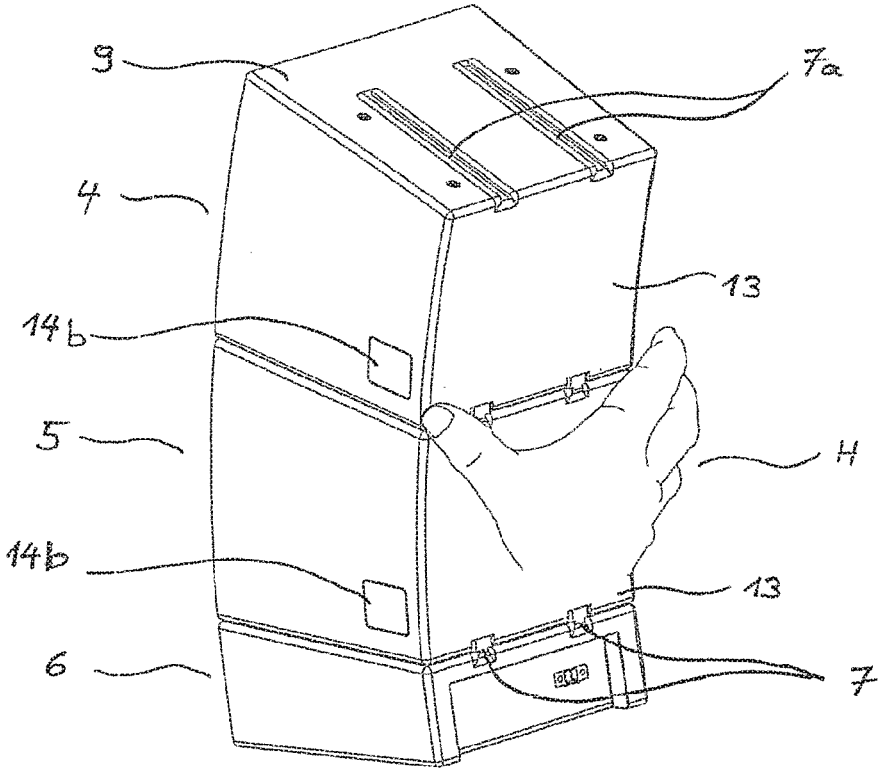
FIG. 5 is a perspective view of a mounted loudspeaker box of the loudspeaker box arrangement.

FIG. 4 shows, in a perspective illustration, the mounting or dismounting of a loudspeaker box 3 on or from the loudspeaker box arrangement 1, which in FIG. 4 comprises the loudspeaker boxes 3, 4 and 5 and the connection device 6. To this end a hand H of an operator grips the loudspeaker box 3. The loudspeaker boxes 3, 4 and 5 have a width that enables the operator to respectively grip the loudspeaker boxes 3, 4, 5 with one hand from their rear sides 13 opposite to the respective loudspeaker sides. Each of the loudspeaker boxes 3, 4, 5 comprises a pushbutton 14*b* by means of which a locking of a connecting device 7 can be unlocked by pressing the pushbutton into the loudspeaker box 3, 4, 5, said locking being operative in the non-pressed state of the pushbutton 14*b*. For mounting or dismounting a loudspeaker box 3, 4, 5, the box can be connected in the pressed state of the pushbutton 14*b* by sliding along the path of a guide groove 7*a* of a neighboring loudspeaker box 3, 4, 5 to the latter or can be removed therefrom. For mounting a loudspeaker box 3, 4, 5 a mating surface (not visible in FIG. 4), which is arranged opposite to the top surface 9 of the loudspeaker box 3, 4, 5 on the loudspeaker box 3, 4, 5, is put on the top surface 9 of the neighboring loudspeaker box 3, 4, 5. To prevent the collision thereof, the complementary guide bases (not visible in FIG. 4) do not extend up to the loudspeaker side of loudspeaker box 3, 4, 5, which side is just visible in FIG. 4 as an edge. The guide bases are threaded into the guide grooves 7*a* for establishing the connection by means of the connecting device 7 and are advanced in said grooves until an alignment of the loudspeaker boxes 3, 4, 5 is achieved. The pushbutton 14*b* can subsequently be released to effect a locking of the loudspeaker boxes 3, 4, 5 with one another. This state is shown in FIG. 5, in which the loudspeaker box arrangement only comprises two loudspeaker boxes 4 and 5. It is also conceivable to design the locking device such that the pushbutton 14*b* need not be pressed for connection purposes, but the locking bolts are held during insertion by contact on a surface in the groove in the unlocking position; it is also conceivable here that they can be brought into this position by the connection of two loudspeaker boxes.

Figure 6:
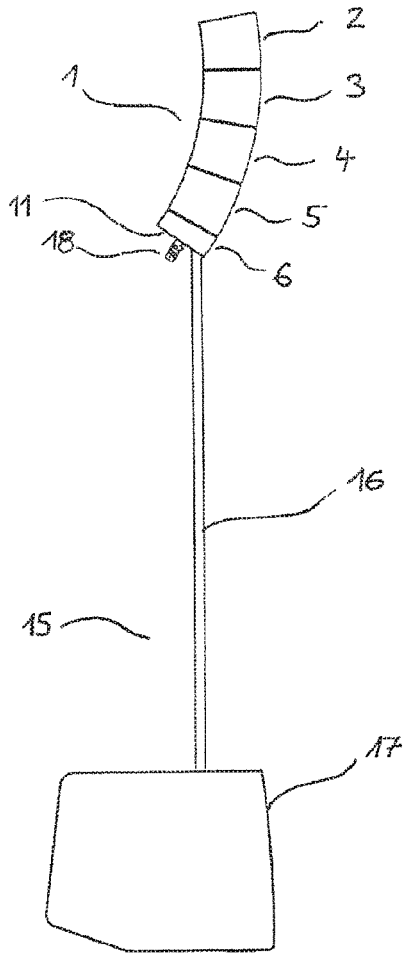
FIG. 6 is a side view of the loudspeaker box arrangement which is held by a holder with a holding rod.
Figure 7:
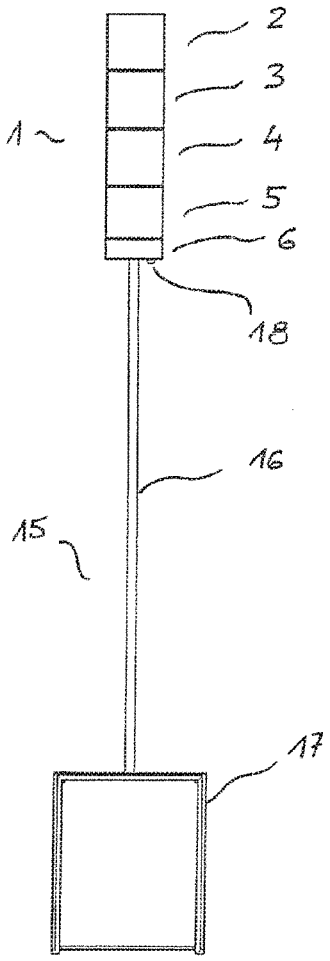
FIG. 7 shows the loudspeaker box arrangement of FIG. 6 in a front view.

FIG. 6 shows the loudspeaker box arrangement 1 in a side view, with the loudspeaker box arrangement 1 being arranged on a holder. The holder 15 comprises a base 17 and a holding rod 16 which is inserted into a holding hollow, not explicitly illustrated, of the connection device 6. In FIG. 6 the loudspeaker box arrangement 1 comprises the loudspeaker boxes 2, 3, 4, 5 and the connection device 6. For the electrical supply of the loudspeaker box arrangement the connection device 6 has an electrical connection 18. The holding rod 16 is preferably made so long that the loudspeaker box arrangement 1 is arranged at least in part above an average head height of the audience. On account of their different emission directions which extend in relation to the loudspeaker box arrangement 1 substantially radially through the center in vertical direction of each of the loudspeaker boxes, the loudspeaker boxes 2, 3, 4 and 5 expose listeners to sound, said listeners being positioned at different distances from the loudspeaker box arrangement 1. The inclination of the loudspeaker box arrangement 1, which is shown in FIG. 6, has the effect that the uppermost one 2 of the loudspeaker boxes emits sound easily upwards, so that even listeners at an elevated position can be reached by high-quality sound. The holding rod 16 is connected to the connection device 6 in relation to the bottom side 31 thereof at a connection angle of about 30°. Due to other connection angles the loudspeaker box arrangement 1 can have a different orientation with respect to listeners, so that the individual loudspeaker boxes 2, 3, 4, 5 can reach closer or more remote areas of an audience. Another connection angle can be achieved by inserting the holding rod 16 into another holding hollow of the connection device 6, which hollow extends at a different angle into the interior of the connection device 6. FIG. 7 shows the same loudspeaker box arrangement 1 and the same holder 16 in a front view.

Figure 8:
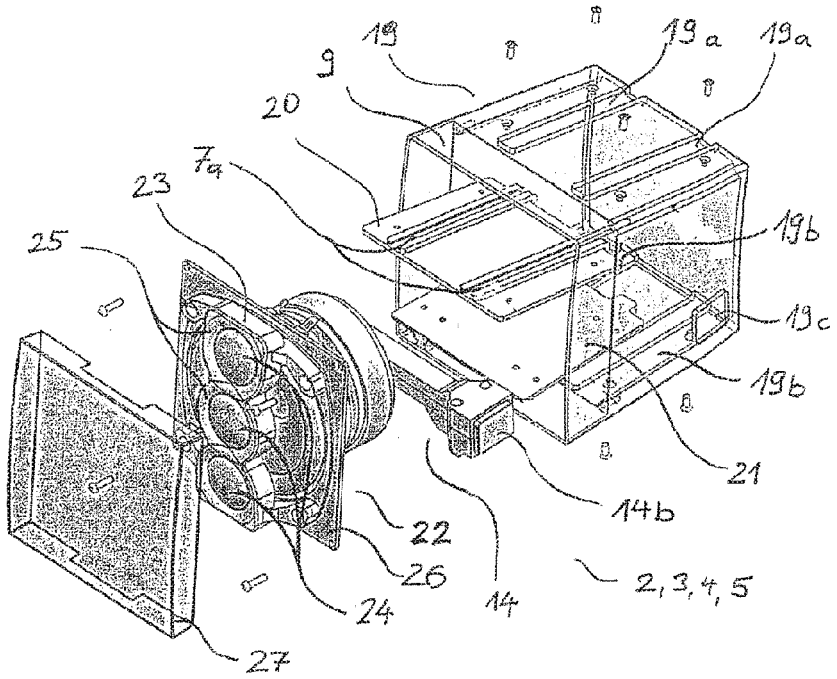
FIG. 8 is a perspective exploded view of a loudspeaker box.

FIG. 8 shows the internal structure of an embodiment of a loudspeaker box 2, 3, 4, 5 in an exploded view. The loudspeaker box 2, 3, 4, 5 comprises a housing 19 which is preferably made from metal, particularly from a metal, particularly from aluminum. Alternatively, the housing 19 may also be made of a plastic material, which offers cost advantages. The housing 19 comprises two recesses 19*a* and 19*b* in its top surface 9; these are provided to make the guide grooves 7*a* accessible. The guide grooves 7*a* are arranged on a guide groove carrier 20 which is preferably made, including the guide grooves 7*a*, from a plastic material. Since the guide grooves 7*a* may also comprise electrical counter-contacts, these are electrically insulated from one another because of such a material selection. Two guide bases which in FIG. 8 are oriented downwards are arranged, shown in FIG. 8 only in a very small section, on a guide base carrier 21. They are configured to exit through the recesses 19*b* out of the housing 19. Hence, they project from the housing 19, so that they can engage into guide grooves 7*a* of another loudspeaker box 2, 3, 4, 5, which are set back with respect to a top surface 9. The guide groove carrier 20 and the guide base carrier 21 are each mounted in the interior of the housing 19.

A recess 19*c* in a sidewall of the housing 19 is provided for the passage of a pushbutton 14*b*. The pushbutton 14*b* is part of a locking device 14. The locking device 14 comprises several locking bolts (not shown) which extend through the guide base carrier 21 and are movable by means of the pushbutton 14*b*.

A mid-range loudspeaker 22 with a chassis 26 is arranged at the loudspeaker side of the loudspeaker box 2, 3, 4, 5. A high-range loudspeaker unit 23 is attached to the chassis 26. The high-range loudspeaker unit 23 comprises three high-range loudspeakers 23. The high-range loudspeakers 24 are accommodated in recesses for high-range loudspeaker unit 23. On their edge directed towards the outside of the loudspeaker box 2, 3, 4, 5, the recesses have a slant 25 extending in the direction of the respective high-range loudspeaker 24 and in the direction of the interior of the loudspeaker box 2, 3, 4, 5. This slant 25 serves an advantageous sound emission of the high-range loudspeakers 24. The emitted sound, in particular, is more strongly focused. This helps to achieve a wave front as uniform as possible of the three high-range loudspeakers 24 and particularly also of a plurality of loudspeaker boxes 2, 3, 4, 5 that are plugged together.

Furthermore, the loudspeaker box 2, 3, 4, 5 comprises a plurality of screws which serve to fasten attachment parts, such as the guide groove carrier 20, the guide base carrier 21, the chassis 26 of the mid-range loudspeaker 22, etc. Furthermore, the loudspeaker box 2, 3, 4, 5 in the illustrated embodiment comprises a loudspeaker cover 27.

Figure 9:
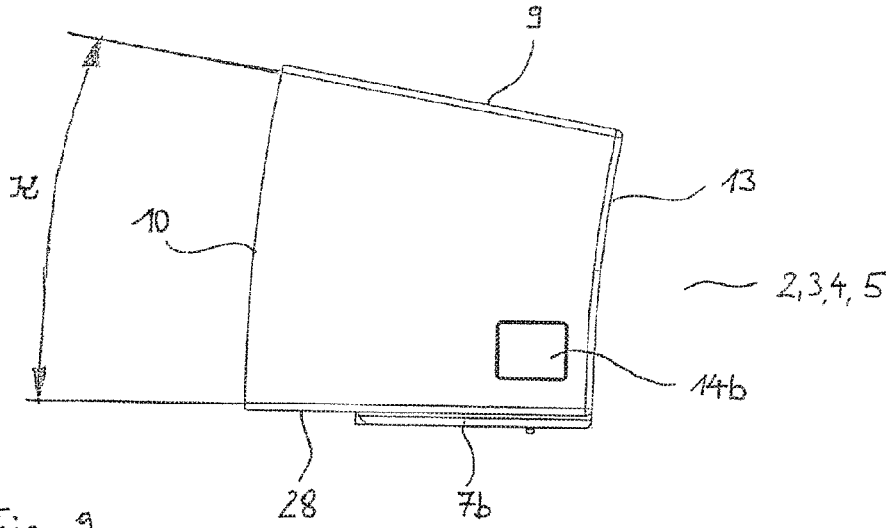
FIG. 9 is a side view of a loudspeaker box.

FIG. 9 shows a side view of a loudspeaker box 2, 3, 4, 5. The top surface 9 is arranged on the upper side of the loudspeaker box 2, 3, 4, 5, while the mating surface 28 is arranged opposite to it on the bottom side of the loudspeaker box 2, 3, 4, 5. The top surface 9 and the mating surface 28 are arranged relative to each other at an angle of curvature κ. The angle of curvature κ is 10° in the illustrated embodiment. Projecting from the mating surface 28 downwards, a guide base 7*b* is visible.

Figure 10:
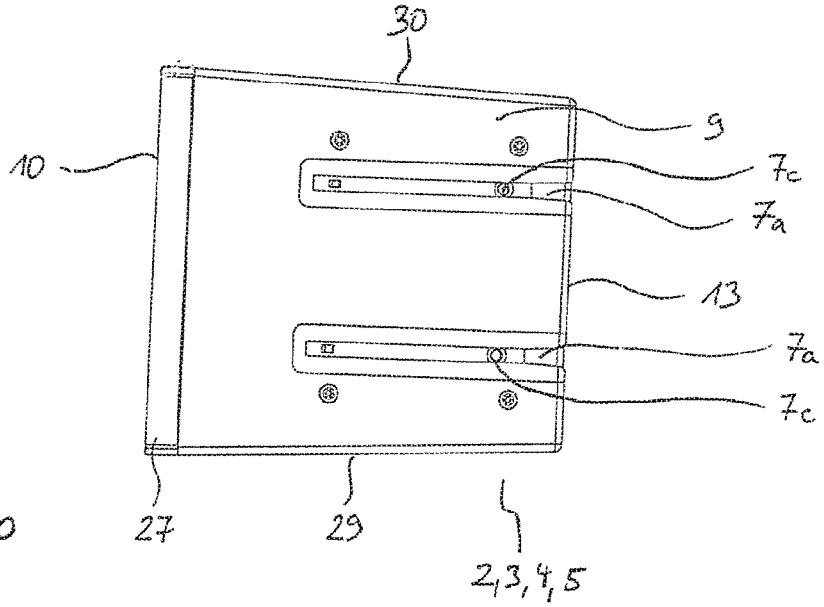
FIG. 10 is a top view on a loudspeaker box.
Figure 11:
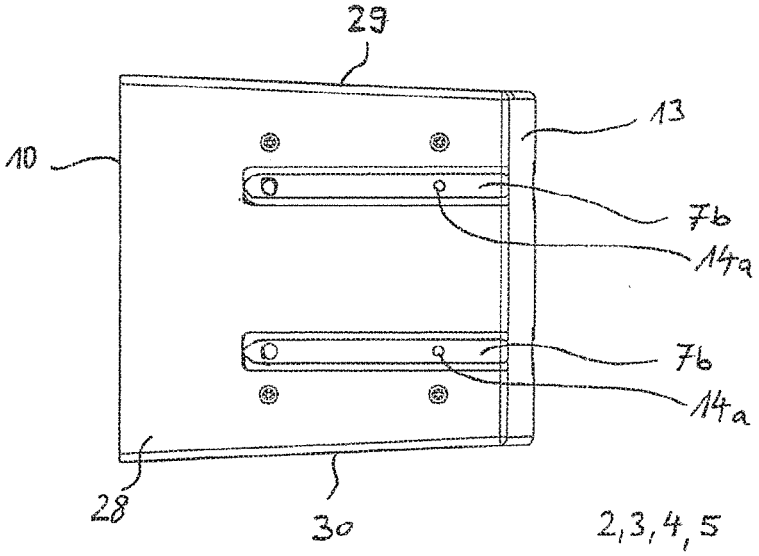
FIG. 11 is a bottom view of a loudspeaker box.
Figure 12:
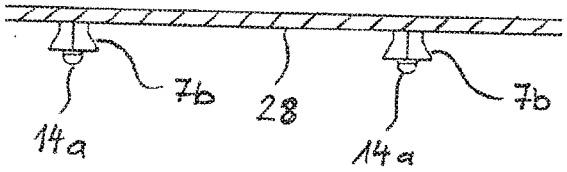
FIG. 12 is a detail view of a pair of guide bases of a loudspeaker box.

FIG. 10 shows a top view on a loudspeaker box 2, 3, 4, 5, the top surface 9 being visible in a planar form. FIG. 11 is a view of the loudspeaker box 2, 3, 4, 5 from below, the mating surface 28 being visible in a planar form. As can be seen in FIGS. 10 and 11, the side surfaces 29 and 30 of the loudspeaker box 2, 3, 4, 5 can also be arranged at an angle relative to one another, said angle opening in the direction of the loudspeaker side 10. As can further be seen in FIG. 11, a respective locking bolt 14*a* is arranged in the interior of the guide base 7*b*. FIG. 12 shows a section of the mating surface 28 in a cross section, which is shown with a view from the loudspeaker side 10 onto the guide base 7*b*. The guide bases 7*b* are positioned behind the cross-sectional plane and are therefore not shown in a cut form. The guide bases 7*b* are respectively penetrated by a locking bolt 14*a*. The locking bolts 14*a* project beyond the guide bases 7*b* downwards, thereby extending away from the mating surface 28. The locking bolts 14*a* can be retracted by pushing the pushbutton 14*b* to such an extent that their free ends will each disappear in the interior of the guide bases 7*b*. A locking of guide grooves 7*a* and guide bases 7*b* of two neighboring loudspeaker boxes 2, 3, 4, 5 can thereby be unlocked, with the locking bolts 14*a* locking into recesses 7*c* in the guide grooves 7*a*. The recesses 7*c* are shown in FIG. 10 and are arranged in guide grooves 7*a* at a complementary place with respect to the positions of the locking bolts 14*a* on the guide bases 7*b*. The guide groove 7*a* and the guide base 7*b* can be slid relative to each other by unlocking the locking.

Figure 13:
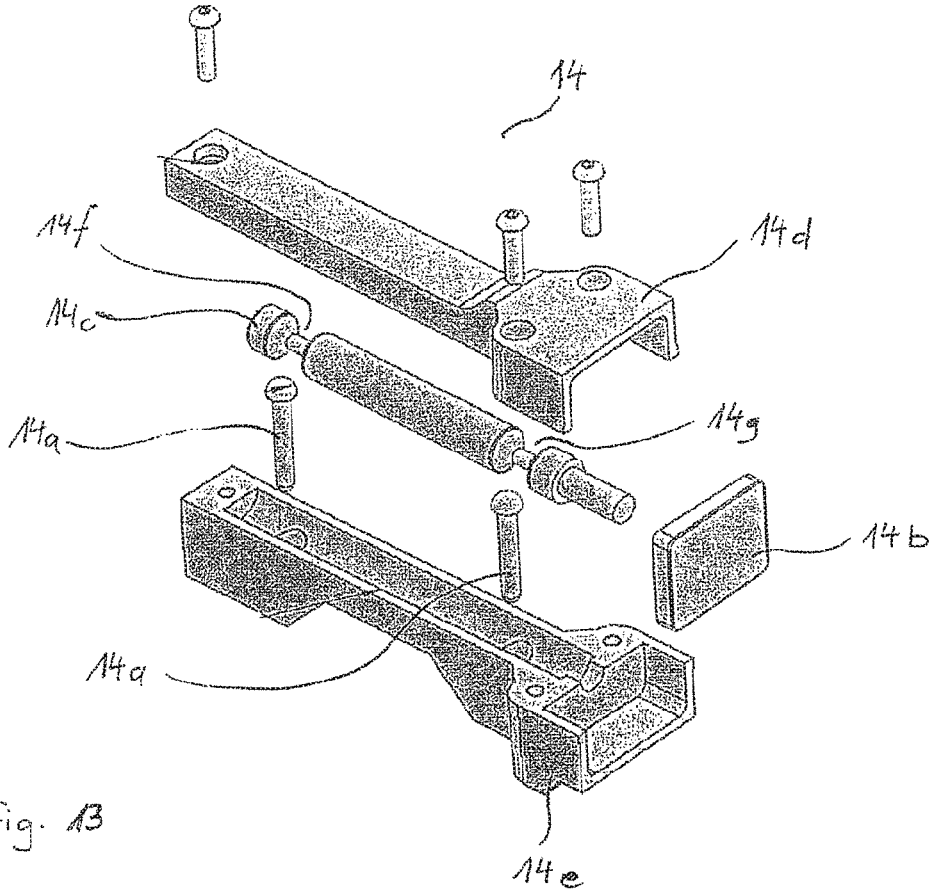
FIG. 13 is a perspective exploded view of a locking device.

FIG. 13 shows a locking device 14 in a perspective exploded view. The locking device 14 comprises an upper housing element 14*d* and a lower housing element 14*e* between which a push rod 14*c* is arranged. The locking device 14 further comprises a pushbutton 14*b* which is positioned between the two housing elements 14*d* and 14*e*. The pushbutton 14*b* is spring-biased in the direction of the exterior of the locking device 14 and is connected to the push rod 14*c* such that a pressing of the pushbutton 14*b* effects a movement of the push rod 14*c* in the longitudinal direction thereof. The push rod 14*c* comprises two grooves 14*f* and 14*g*, each having a slanted front surface. In the retracted state of the locking bolts 14*a*, the ends thereof, which are directed into the interior of the locking device 14, project into the grooves 14*f* and 14*g*. The locking bolts 14*a* are spring-biased in the direction of the interior of the locking device 14. A release of the pushbutton 14*b* has the effect due to the bias of the pushbutton 14*b* and the push rod 14*c* that the push rod 14*c* in FIG. 13 moves to the right side, whereby the ends of the locking bolts 14*a* are displaced out of the grooves 14*f* and 14*g* against their spring bias. The locking bolts 14*a* can thereby lock in place in suitable hollows and a locking action can be achieved.

Figure 14:
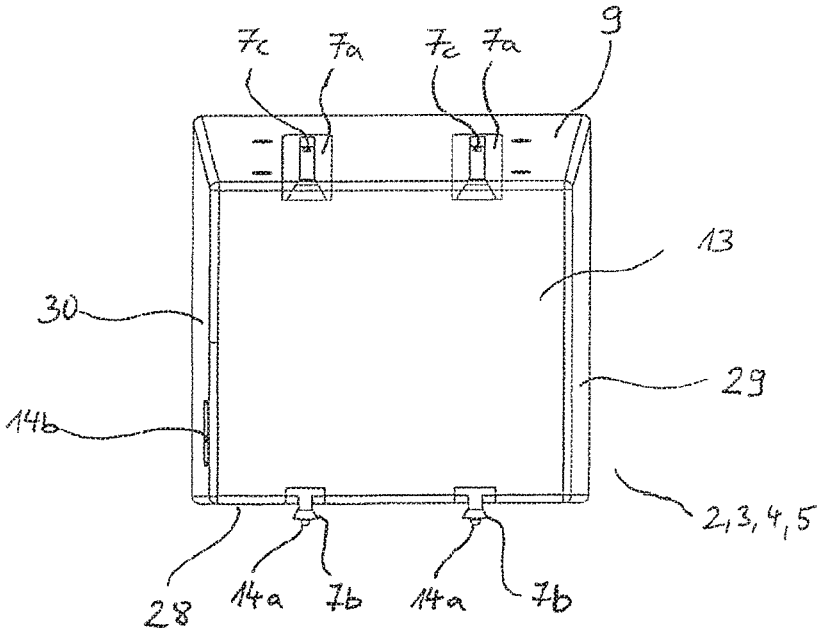
FIG. 14 is a view of a loudspeaker box from behind.

FIG. 14 shows a view of a loudspeaker box from behind. The rear side 13 is shown in a planar form. The guide bases 7*b* are visible in profile. It is apparent that they can engage with their enlarged end into an undercut of a guide groove 7*a* to connect two loudspeaker boxes 2, 3, 4, 5.

Figure 15:
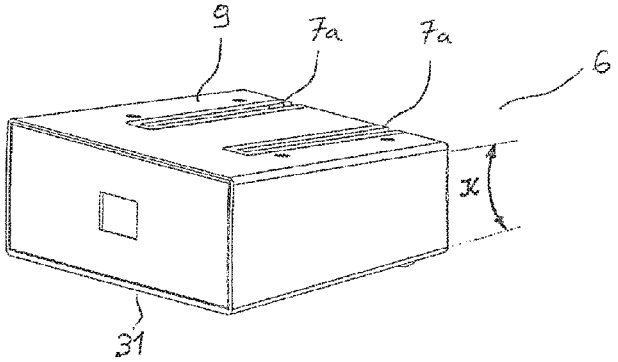
FIG. 15 is a perspective view of a connection device in the assembled state.
Figure 16:
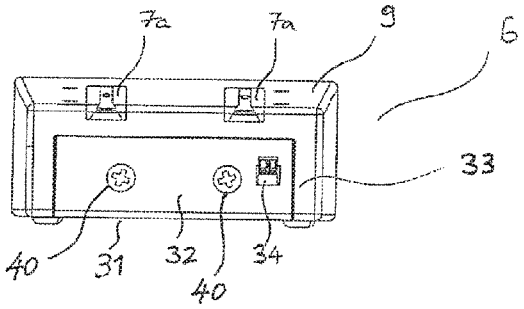
FIG. 16 is a view of a connection device from behind.

FIG. 15 is a perspective view of a connection device 6. Two guide grooves 7*a* are arranged on a top surface 9 which is oriented by analogy with the top surface 9 of the loudspeaker boxes 2, 3, 4, 5 on the connection device 6. Guide bases of a loudspeaker box 2, 3, 4, 5 can be slid into said guide grooves 7*a* to connect the loudspeaker box 2, 3, 4, 5 to the connection device 6. A bottom side 31 of the connection device 6, which corresponds to a mating surface 28 of one of the loudspeaker boxes 2, 3, 4, 5, is positioned at an angle of curvature relative to the top surface 9 of the connection device 6. The angle of curvature is preferably smaller than the angle of curvature of the loudspeaker boxes 2, 3, 4, 5. Like in the case of the loudspeaker boxes 2, 3, 4, 5, this yields the property that a bent part of an arcuate loudspeaker box arrangement 1 can be formed. Specifically, the connection device has a lower height than the loudspeaker boxes. FIG. 16 shows the same connection device 6 from behind. The rear side 33 has arranged thereon a mechanical connecting portion 32 and a cable fastening device 34 for the electrical connection of the connection device 6. An element (not shown) can be screwed to the mechanical connecting portion 32 for holding the connection device 6. Screws 40 by means of which the element for holding can be fastened to the connection device can be screwed onto the rear side 33 of the connection device 6.

Figure 17:
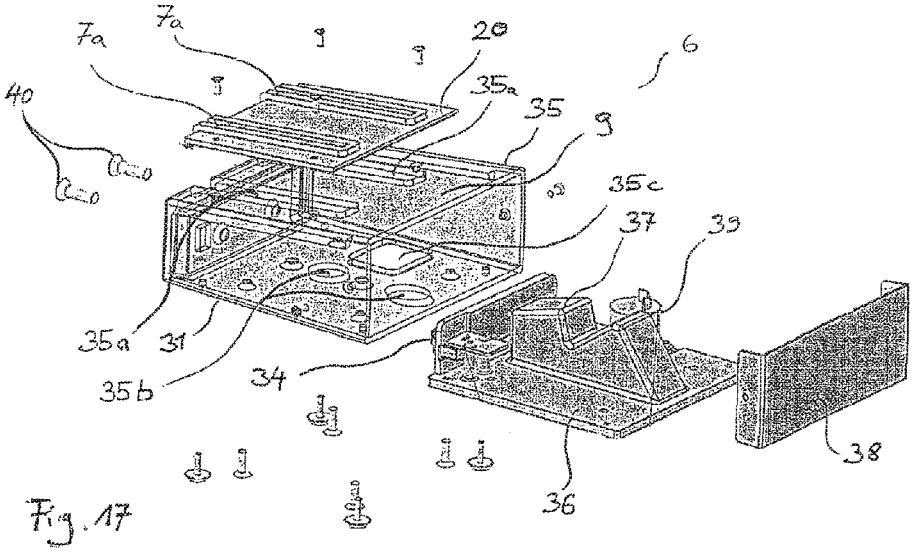
FIG. 17 is a perspective exploded illustration of a connection device.

FIG. 17 shows, in a perspective exploded view, an internal structure of the connection device 6. The connection device 6 comprises a housing 35 which comprises recesses 35*a* penetrating the top surface 9 thereof for the passage of guide grooves 7*a*. The guide grooves 7*a* are arranged on a guide groove carrier 20, as is preferably also used for loudspeaker boxes 2, 3, 4, 5. Like in the case of the loudspeaker boxes 2, 3, 4, 5, the guide groove carrier 20 is mounted in the interior of the housing 35. The housing 35 is preferably made from metal, particularly from aluminum. Alternatively or in addition, it may also be made from plastic or comprise plastic. In the mounted state an inner part 36 on which electrical components may be arranged is arranged in the interior of the connection device 6. Specifically, the cable connecting device 34 is fastened there. Holding hollows 12 extend inwards in a bulge 37 in the interior of the connection device 6 from the exterior into the interior of the connection device 6; these are accessible from the bottom side of the inner part 36. In the illustrated embodiment, two holding hollows 12 are provided and extend at different angles into the interior of the connection device 6. The bulge 37 is particularly a molding of the holding hollows in the inner part 36 of the connection device 6. The holding hollows 12 in the inner part 36 are in alignment with openings 35*b* in the bottom side 31 of the housing. Furthermore, the connection device 6 comprises a front panel with which it can be closed. For the connection of the connection device 6 the inner part comprises an electrical loudspeaker connection 39 which is particularly of the Speakon type. Preferably, the loudspeaker connection 39 is connected in parallel with an electrical part of the cable fastening device 34. A flange for holding the connection device 6 can be fastened thereto. To this end the flange can particularly penetrate the housing through an opening 35*c*.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A loudspeaker box arrangement, comprising:

at least two loudspeaker boxes, each comprising at least a mid-range loudspeaker device and a high-range loudspeaker unit arranged at a distance therefrom;

a mechanical connecting device for mechanically connecting the loudspeaker boxes;

an electrical connecting device for the electrical supply of the mid-range loudspeaker device and high-range loudspeaker unit;

wherein the mechanical connecting device comprises a pair of spaced-apart guide grooves on a top surface of a loudspeaker box and a compatible pair of guide bases on a mating surface of a neighboring loudspeaker box, which in the mounted state engage each other, wherein the guide grooves extend through a rear side of the loudspeaker box and the guide bases do not extend to a loudspeaker side of the loudspeaker box;

wherein the guide bases are slidable into the guide grooves for establishing the connection; and wherein the electrical connecting device comprises a first pair of electrical contacts in the guide grooves, or, the guide grooves being designed as contacts, which are contacted in the mounted state of the mechanical connecting device.

2. The loudspeaker box arrangement according to claim 1, wherein counter-contacts are respectively arranged on the guide bases, or the guide bases are configured as counter-contacts.

3. The loudspeaker box arrangement according to claim 2, wherein the loudspeaker boxes are electrically connected in parallel by being electrically interconnected via the contacts and the counter-contacts.

4. The loudspeaker box arrangement according to claim 1, wherein the top surface and the mating surface of a loudspeaker box are at an angle of curvature (κ) with each other.

5. The loudspeaker box arrangement according to claim 4, wherein the loudspeaker box arrangement is made arcuate by the angle of curvature (κ) of the loudspeaker boxes.

6. The loudspeaker box arrangement according to claim 4, wherein all loudspeakers of a loudspeaker box are arranged at the loudspeaker side of the loudspeaker box, and the loudspeaker side is arranged between the top surface and the mating surface, and the top surface and the mating surface at the loudspeaker side are maximally spaced apart due to the angle of curvature (κ).

7. The loudspeaker box arrangement according to claim 1, wherein in the high-range loudspeaker unit a plurality of high-range loudspeakers are arranged in a row and extend at the loudspeaker side in a direction from the top surface to the mating surface, wherein especially two or three high-range loudspeakers are provided in the row.

8. The loudspeaker box arrangement according to claim 1, wherein the high-range loudspeaker unit is arranged in front of the mid-range loudspeaker device.

9. The loudspeaker box arrangement according to claim 1, wherein the high-range loudspeaker unit is mechanically connected to a chassis of the mid-range loudspeaker device.

10. The loudspeaker box arrangement according to claim 9, wherein the chassis of the mid-range loudspeaker device or an element connected thereto is connectable or is connected to a loudspeaker cover by means of a plurality of magnets, wherein the magnets are arranged on the chassis or/and the element connected thereto or/and on the loudspeaker cover.

11. The loudspeaker box arrangement according to claim 4, wherein the orientation of the high-range loudspeaker follows a curvature which is predetermined by the angle of curvature (κ).

12. The loudspeaker box arrangement according to claim 1, wherein a high-range loudspeaker is arranged behind an opening in the high-range loudspeaker unit with an edge that is slanted in the direction of the high-range loudspeaker and in the direction of the interior of the loudspeaker box, wherein sound of the high-range loudspeaker can be emitted through the opening.

13. The loudspeaker box arrangement according to claim 12, wherein a sound emission surface of the high-range loudspeaker has a dome shape and the high-range loudspeaker is magnetically drivable.

14. The loudspeaker box arrangement according to claim 1, wherein a foam layer is arranged next to the high-range loudspeaker unit for at least partly preventing the penetration of high-tone sound generated by the high-range loudspeaker unit into the loudspeaker box.

15. The loudspeaker box arrangement according to claim 1, wherein the mechanical connecting device is detachable and fixable by means of a mechanically operable locking device.

16. The loudspeaker box arrangement according to claim 15, wherein the locking device comprises a pushbutton by means of which at least one locking bolt is retractable when pressed for unlocking and can be advanced when released for locking, particularly via a sliding surface which moves with the locking bolt, and a sliding surface which moves with the pushbutton, wherein preferably the sliding surfaces are arranged at least in sections slanted with respect to the engagement direction of the pushbutton and slanted with respect to the direction of movement of the locking bolt.

17. The loudspeaker box arrangement according to claim 16, wherein the pushbutton is arranged laterally on the loudspeaker box.

18. The loudspeaker box arrangement according to claim 1, wherein a width of a rear side of the loudspeaker boxes is less than 15 cm, particularly less than 12 cm, the width being parallel to the top surface.

19. The loudspeaker box arrangement according to claim 1, wherein the loudspeaker box arrangement comprises a connection device which includes a component of the mechanical connecting device which is suited for connection to the loudspeaker box or comprises a component of the electrical connecting device for contacting the loudspeaker box.

20. The loudspeaker box arrangement according to claim 19, wherein the connection device comprises a holding hollow for plugging the connection device onto a holding rod.

21. The loudspeaker box arrangement according to claim 19, wherein the connection device comprises a plurality of holding hollows on a bottom side directed during operation towards the floor, each extending at a different angle of inclination into the interior of the connection device.

22. The loudspeaker box arrangement according to claim 21, wherein the holding hollows are arranged centrally and in sound emission direction of the loudspeaker boxes one after the other.

23. The loudspeaker box arrangement according to claim 19, wherein a wall holder is connected to the connection device, the wall holder having a mechanical connection, which is tiltable by means of a hinge, between the connection device and the wall, so that the connection device for plugging loudspeaker boxes is made accessible by tilting.

24. The loudspeaker box arrangement according to claim 19, wherein a top side and a mating side of the connection device are arranged at an angle of curvature (κ) relative to each other.

25. A loudspeaker box, comprising:

at least a mid-range loudspeaker device and a high-range loudspeaker unit spaced therefrom, a mechanical connecting device for mechanically connecting the loudspeaker box to another loudspeaker box, an electrical connecting device for the electrical supply of the mid-range loudspeaker device and high-range loudspeaker unit, wherein the loudspeaker box for connection to another loudspeaker box includes, as part of the mechanical connecting device, a pair of spaced-apart guide grooves on a top surface of the loudspeaker box and, as a further part of the mechanical connecting device, a pair of guide bases compatible with the guide grooves on a mating surface arranged spaced-apart from the top surface, wherein the guide grooves extend through a rear side of the loudspeaker box and the guide bases do not extend to a loudspeaker side of the loudspeaker box, and that the electrical connecting device comprises a first pair of electrical contacts in the guide grooves as contacts or the guide grooves are configured as contacts, wherein the contacts in the mounted state of the mechanical connecting device are electrically contactable from outside the loudspeaker box by means of complementary counter-contacts of a unit to be connected.

* * * * *